US007615930B2

(12) United States Patent
Hrubowchak et al.

(10) Patent No.: US 7,615,930 B2
(45) Date of Patent: Nov. 10, 2009

(54) SHROUDED ARC DISCHARGE LAMP SUITABLE FOR DOWNLIGHTING APPLICATIONS

(75) Inventors: David M. Hrubowchak, Litchfield, NH (US); Paul W. Oberlies, Manchester, NH (US); Steven A. Collins, Lowell, MA (US)

(73) Assignee: Osram Sylvania Inc., Danvers, MA (US)

( * ) Notice: Subject to any disclaimer, the term of this patent is extended or adjusted under 35 U.S.C. 154(b) by 265 days.

(21) Appl. No.: 11/474,884

(22) Filed: Jun. 26, 2006

(65) Prior Publication Data

US 2007/0296340 A1 Dec. 27, 2007

(51) Int. Cl.
*H01J 1/62* (2006.01)

(52) U.S. Cl. ..... 313/634; 313/25; 313/493; 313/318.02

(58) Field of Classification Search ..... 313/25, 313/318.01, 634, 318.04, 491, 493, 318.02; 439/417–419, 669.2, 611–619, 734
See application file for complete search history.

(56) References Cited

U.S. PATENT DOCUMENTS

| | | | | |
|---|---|---|---|---|
| 4,281,274 | A | 7/1981 | Bechard et al. | |
| 4,499,396 | A | 2/1985 | Fohl et al. | |
| 4,500,948 | A | 2/1985 | Blaisdell et al. | 362/396 |
| 4,580,989 | A | 4/1986 | Fohl et al. | |
| 4,779,021 | A * | 10/1988 | Haraden | 313/25 |
| 4,888,517 | A | 12/1989 | Keeffe et al. | |
| 5,051,657 | A * | 9/1991 | Bazin et al. | 315/73 |
| 2003/0057834 | A1 * | 3/2003 | Kling | 313/623 |
| 2006/0158083 | A1 * | 7/2006 | Hrubowchak et al. | 313/252 |

* cited by examiner

*Primary Examiner*—Joseph L Williams
(74) *Attorney, Agent, or Firm*—William H. McNeill

(57) ABSTRACT

A low-wattage, high intensity arc discharge electric lamp (10) has a thick-walled outer envelope (12) extending along a longitudinal axis (14) and has a bulbous portion (16) and a narrow, cylindrical base (18) including oppositely disposed grooves (20) extending parallel to the longitudinal axis (14). An electrically conductive mounting member (22) has grippers (24) formed on ends (26) thereof to engage the grooves (20). The electrically conductive member (22) has a center portion (28) with a U-shaped segment (30) that is positioned within the base. An arc tube assembly (32) comprises an arc tube (34) having axially extending electrode lead-ins (36, 38) sealed within a shroud (40). The shroud (40) has parallel electrical connections (42, 44) extending therefrom. A first of the electrical connections (42) is electrically and mechanically fixed to the U-shaped segment (30) of the electrically conductive mounting member (22) and a second of the electrical connections (44) is electrically insulated from the mounting member (22) by an insulator (23). A threaded shell (46) is fixed to the base (18), the shell (46) having a first electrical contact (48) electrically connected to the electrically conductive mounting member (22) and a second electrical contact (50) electrically connected to the second of the electrical connections (44).

6 Claims, 4 Drawing Sheets

SHROUDED ARC DISCHARGE LAMP SUITABLE FOR DOWNLIGHTING APPLICATIONS

TECHNICAL FIELD

This invention relates to electric lamps and more particularly to ceramic high intensity discharge lamps. Still more particularly, it relates to low-wattage versions of such lamps in small, heavy-bodied envelopes that are suitable for downlight fixtures.

BACKGROUND ART

High intensity discharge (HID) lamps employ arc discharge tubes of glass or ceramic that operate at pressures much higher than atmospheric pressure. On rare occasions these arc tubes have been known to fail in a non-passive manner and deposit glass shards in a wide area about the lamp. Because of this problem such lamps have had to be operated within an enclosed fixture to offer protection and to provide containment of the shards in the event of a burst of the arc tube. Recently, so-called protected versions of these lamps have been made available. These protected lamps have used a shroud of glass or quartz to surround the arc tube and, in conjunction with a heavy-walled envelope, are capable of being operated in an open fixture. Shrouds for metal halide arc discharge lamps are disclosed in U.S. Pat. No. 4,499,396 issued Feb. 12, 1985 to Fohl et al.; U.S. Pat. No. 4,580,989 issued Apr. 8, 1986 to Fohl et al.; and U.S. Pat. No. 4,888,517 to Keeffe et al, issued Dec. 19, 1989. See also U.S. Pat. No. 4,281,274 issued Jul. 28, 1981 to Bechard et al. However, these lamps still have a relatively large body using a mogul base and are not suited for operation in downlight fixtures. The lamps used in downlighting applications are typically incandescent PAR and E17 lamps as well as T4/T6 bi-pin types. It would be advantageous if a low-wattage (e.g., <100 watts), medium screw base lamp with a shorter overall length than a PAR lamp or an E17 lamp could be provided.

DISCLOSURE OF INVENTION

These objects are accomplished, in one aspect of the invention, by the provision of a low-wattage, high intensity arc discharge electric lamp comprising: a thick-walled outer envelope extending along a longitudinal axis and having a bulbous portion and a narrow, cylindrical base including oppositely disposed grooves extending parallel to said longitudinal axis; an electrically conducting mounting member with grippers formed on ends thereof to engage said grooves and having a center portion with a U-shaped segment positioned within said neck; an arc tube assembly comprising an arc tube having axially extending electrode lead-ins sealed within a shroud, said shroud having parallel electrical connections extending therefrom, a first of said electrical connections being electrically and mechanically fixed to said U-shaped segment of said electrically conductive mounting member and a second of said electrical connections being electrically insulated from said mounting member; and a threaded shell fixed to said base, said shell having a first electrical contact electrically connected to said electrically conducting mounting member and a second electrical contact electrically connected to said second of said electrical connections.

This construction provides a HID of low wattage and in a convenient, smaller size that is suitable for downlighting.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
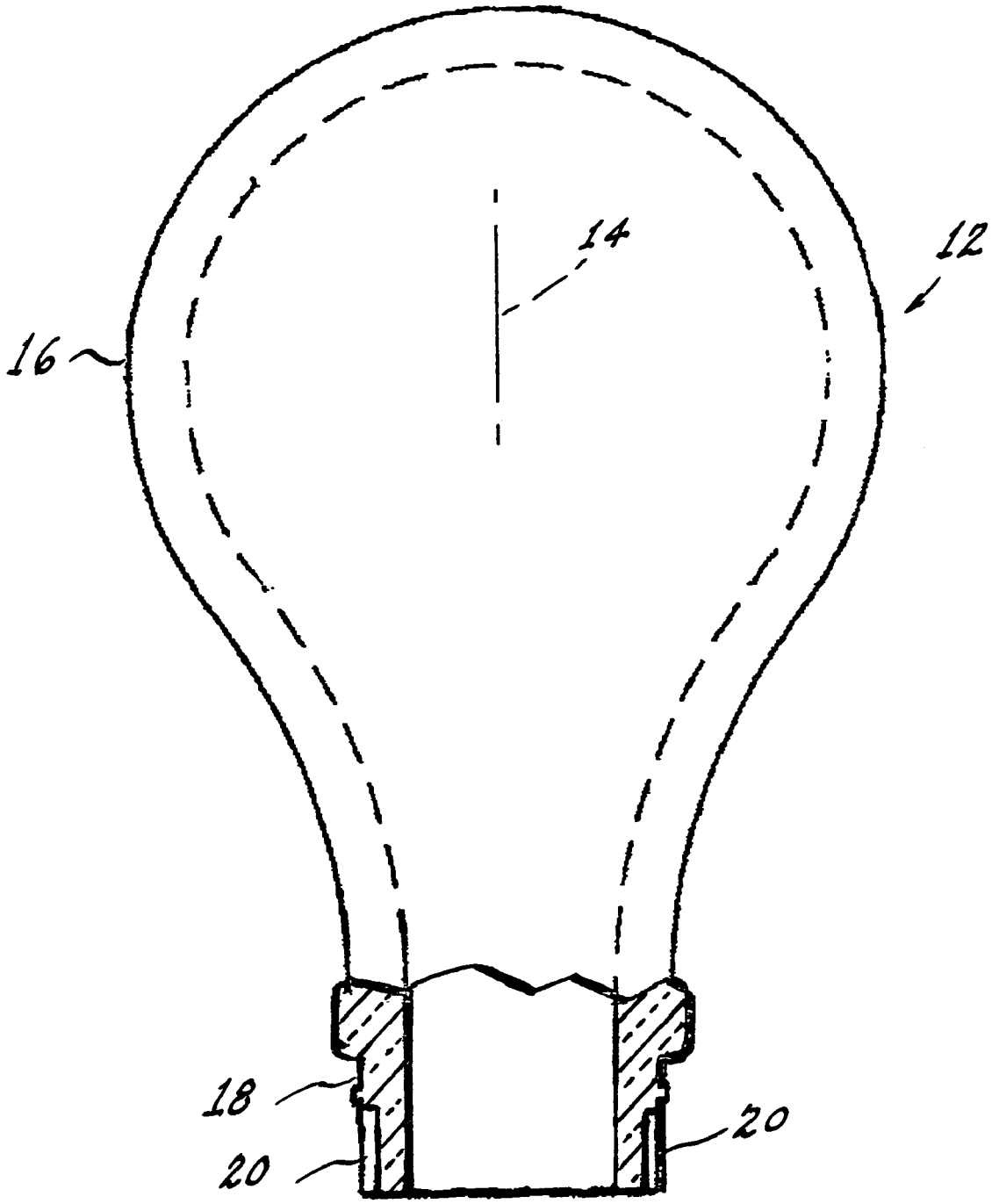
FIG. 1 is an elevational view, partially in section, of a lamp envelope in accordance with an aspect of the invention.
Figure 2:
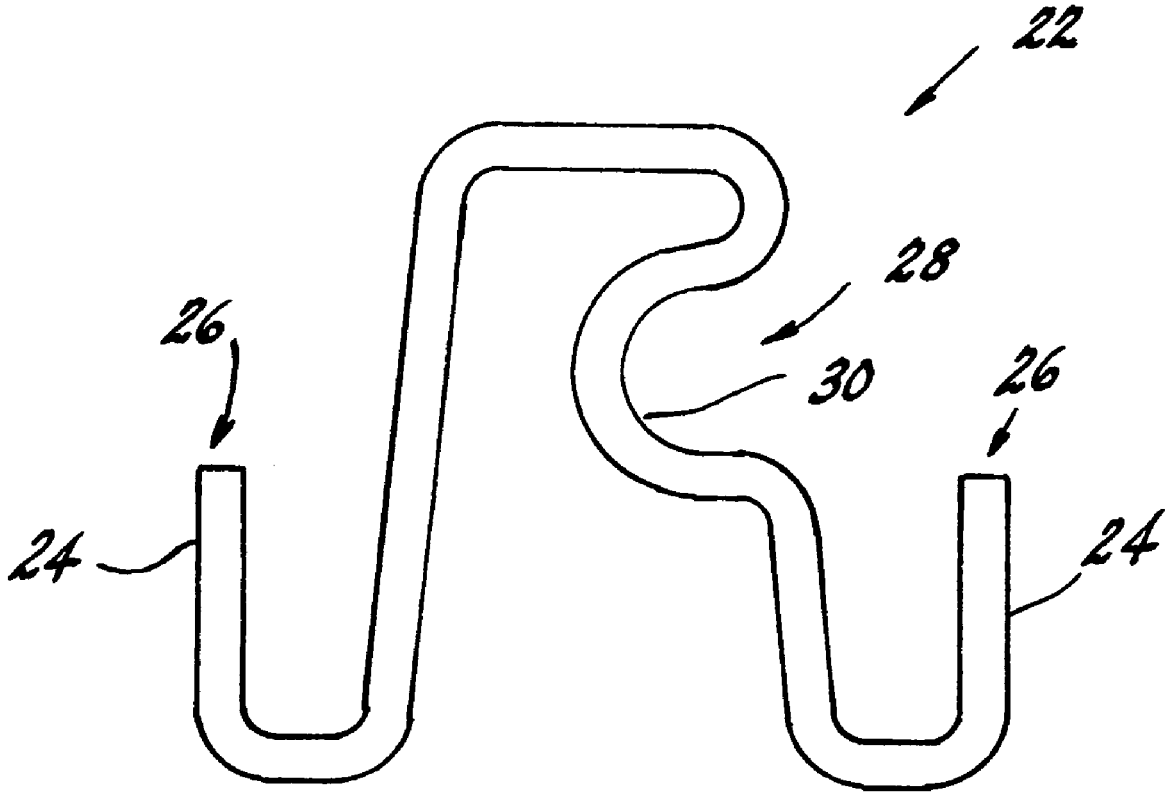
FIG. 2 is an elevational view of an electrically conductive mounting member in accordance with an aspect of the invention.
Figure 3:
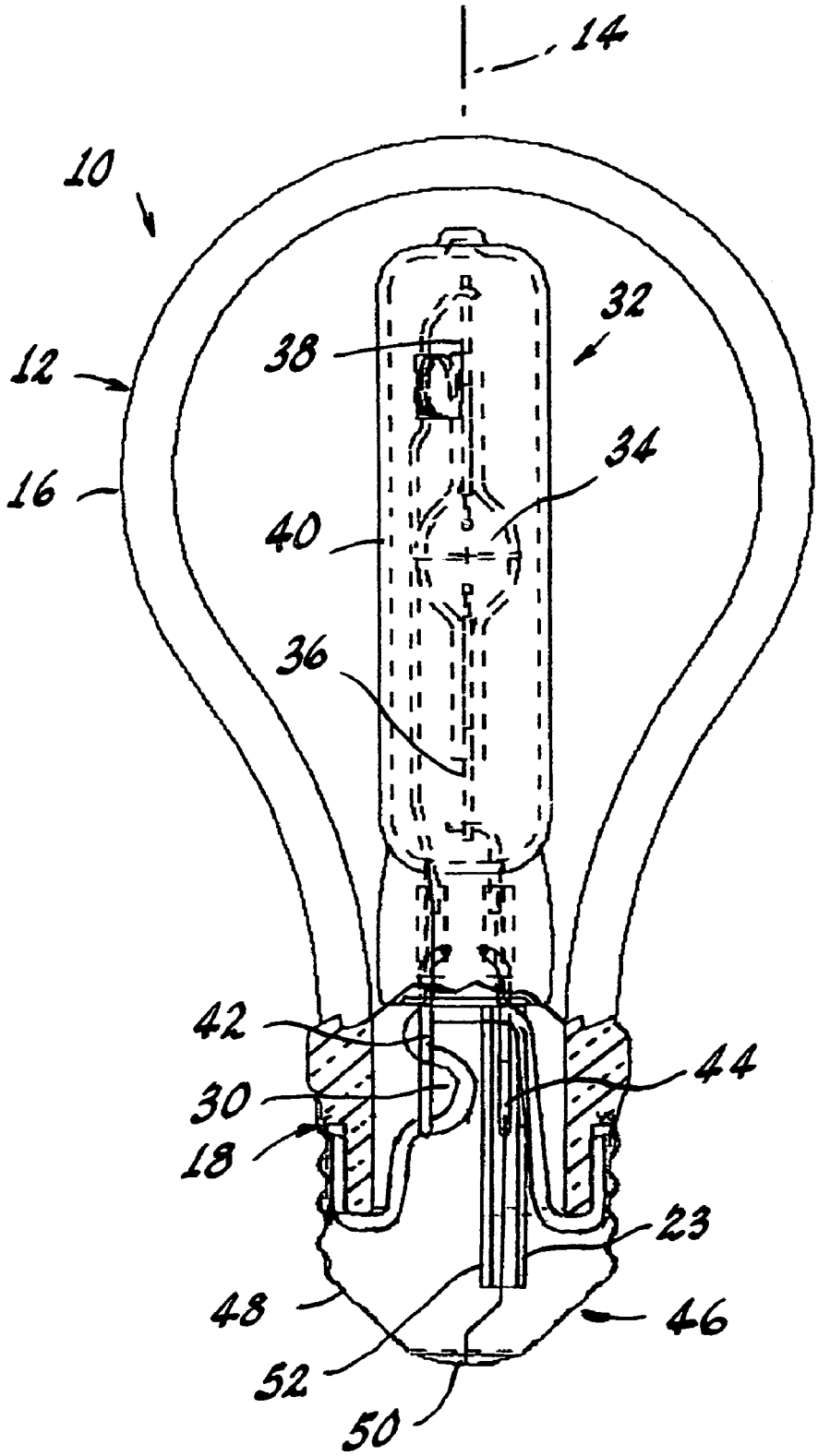
FIG. 3 is an elevational view, partially in section, of a lamp according to an aspect of the invention.
Figure 4:
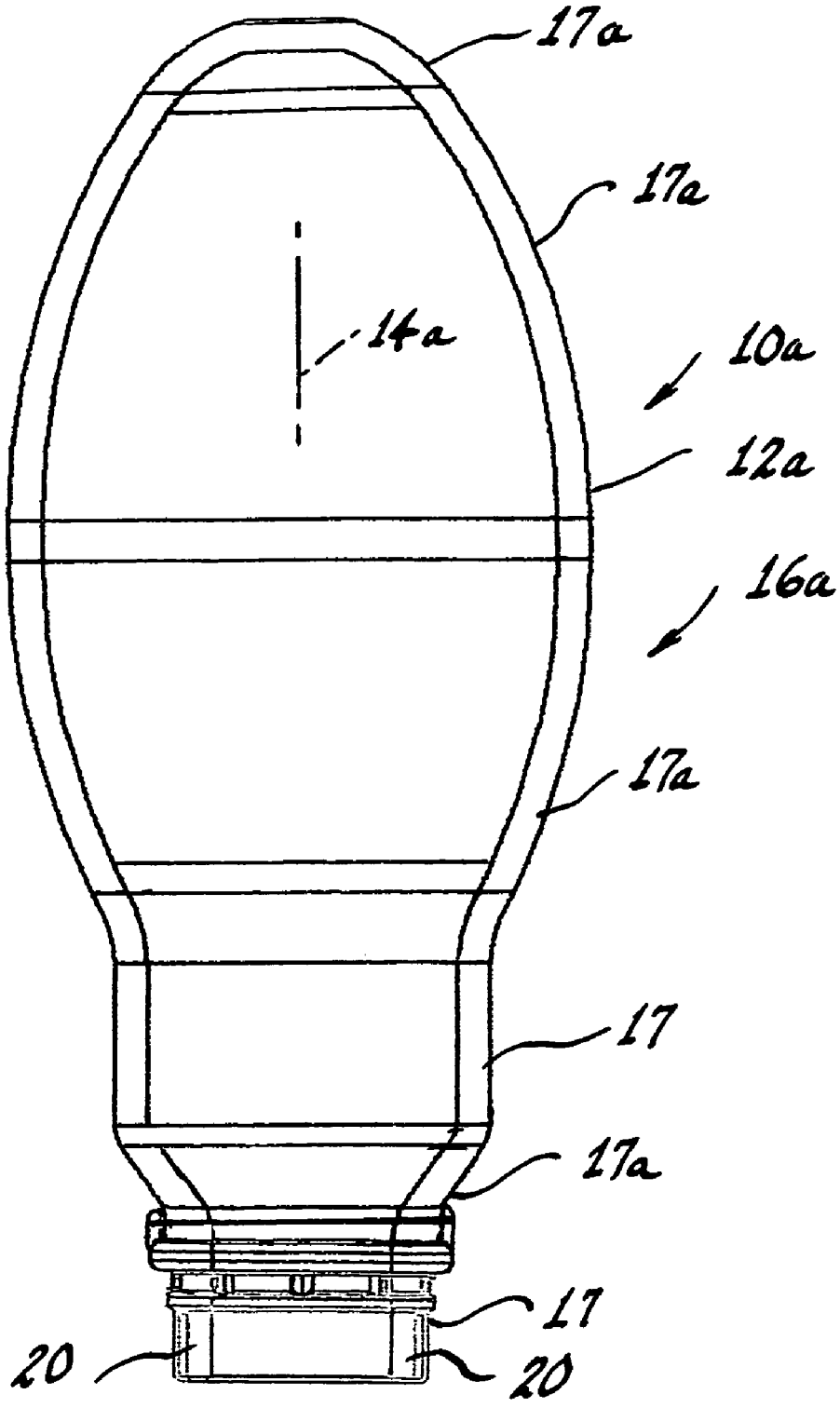
FIG. 4 is a view similar to FIG. 1 of an alternate embodiment of lamp envelope.

Referring now to the drawings with greater particularity, there is shown in FIG. 3 a low-wattage, high intensity arc discharge electric lamp 10 comprising: a thick-walled outer envelope 12 of, for example, borosilicate or lime glass, extending along a longitudinal axis 14 and having a bulbous portion 16 and a narrow, cylindrical base 18 including oppositely disposed grooves 20 extending parallel to the longitudinal axis 14. The grooves 20 are more clearly seen in FIG. 1.

An electrically conductive mounting member 22, preferably formed from stainless steel wire having a diameter of 1.40 mm, has grippers 24 formed on the ends 26 thereof that engage the grooves 20, preferably by friction, and has a center portion 28 with a U-shaped segment 30 positioned within the cylindrical base 18.

An arc tube assembly 32 comprises an arc tube 34, preferably of a ceramic material such as polycrystalline alumina (PCA) and has axially extending electrode lead-ins 36, 38 sealed within a shroud 40. The shroud 40 preferably is constructed of a material known as UV-Stop quartz glass, and has parallel electrical connections 42, 44 extending from a press-seal, as is known in the art. A first of the electrical connections, for example 42, is electrically and mechanically fixed to the U-shaped segment 30 of the electrically conductive mounting member 22 and a second of the electrical connections, for example 44, is electrically insulated from the mounting member 22 by an insulator 23, which can be a glass sleeve 52.

A threaded, medium screw shell 46 is fixed to the base 18. Fixation can be effected by a basing cement or, preferably, by welding the shell to the grippers 24 or, alternatively, by means of a clip, as is known. The shell 46 has a first electrical contact 48 (the screw portion) electrically connected to the electrically conductive mounting member 22 and a second electrical contact 50 (the eyelet) electrically connected to the second of the electrical connections 44.

The lamp has an overall length of about 110 mm, making it smaller even that a typical PAR lamp.

Alternatively, a low-wattage, high intensity arc discharge electric lamp 10*a* can comprise a thick-walled outer envelope 12*a* extending along a longitudinal axis 14*a* and having a body 16*a* composed of a plurality of cylindrical and conical sections 17, 17*a*, with one of said cylindrical sections 17 being a base 18 including the oppositely disposed grooves 20 that extend parallel to said longitudinal axis 14*a* Such a construction is known as an E17 bulb. The electrically conductive mounting member 22 with grippers 24 formed on ends 26 thereof engages the grooves 20 to mount the member 22 to the neck 18. A center portion 28 of the mounting member 22 has a U-shaped segment 30 and is positioned within the base 18, as in the previous embodiment.

The arc tube assembly is similar to that previously described and is similarly mounted.

Thus there is provided a high intensity discharge lamp in a choice of small envelopes that are applicable to downlighting, fulfilling a long-felt need in the commercial lamp area.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. A low-wattage, high intensity arc discharge electric lamp comprising:

a thick-walled outer envelope extending along a longitudinal axis and having a bulbous portion and a narrow, cylindrical base including oppositely disposed grooves extending parallel to said longitudinal axis;

an electrically conducting mounting member with grippers formed on ends thereof to engage said grooves and having a center portion with a U-shaped segment including two arms positioned within said cylindrical base;

an arc tube assembly comprising a ceramic arc tube having axially extending electrode lead-ins sealed within a shroud, said shroud having parallel electrical connections extending therefrom, a first of said electrical connections being electrically and mechanically fixed to said two arms of said U-shaped segment of said electrically conductive mounting member and a second of said electrical connections being electrically insulated from said mounting member by an insulator, said insulator being a glass sleeve; and a threaded shell fixed to said base, said shell having a first electrical contact electrically connected to said electrically conducting mounting member and a second electrical contact electrically connected to said second of said electrical connections.

2. The low-wattage lamp of claim 1 wherein said envelope has a minimum thickness of 3.5 mm.

3. The low-wattage lamp of claim 1 wherein said lamp has an overall length of about 110 mm.

4. The low-wattage lamp of claim 1 wherein said electrically conducting mounting member is constructed from stainless steel wire having a diameter of about 1.40 mm.

5. The low-wattage lamp of claim 1 wherein said grippers frictionally engage said grooves.

6. A low-wattage, high intensity arc discharge electric lamp comprising:

a thick-walled outer envelope extending along a longitudinal axis and having a bulbous portion a body composed of a plurality of cylindrical and conical sections, with one of said cylindrical sections being a base including oppositely disposed grooves extending parallel to said longitudinal axis;

an electrically conducting mounting member with grippers formed on ends thereof to engage said grooves and having a center portion with a U-shaped segment including two arms positioned within said base;

an arc tube assembly comprising a ceramic arc tube having axially extending electrode lead-ins sealed within a shroud, said shroud having parallel electrical connections extending therefrom, a first of said electrical connections being electrically and mechanically fixed to said two arms of said U-shaped segment of said electrically conductive mounting member and a second of said electrical connections being electrically insulated from said mounting member by a glass sleeve; and a threaded shell fixed to said base, said shell having a first electrical contact electrically connected to said electrically conducting mounting member and a second electrical contact electrically connected to said second of said electrical connections.

* * * * *